US006016468A

United States Patent [19]

Freeman et al.

[11] Patent Number: 6,016,468

[45] Date of Patent: Jan. 18, 2000

[54] GENERATING THE VARIABLE CONTROL PARAMETERS OF A SPEECH SIGNAL SYNTHESIS FILTER

[75] Inventors: Daniel Kenneth Freeman; Wing-Tak Kenneth Wong; Andrew Gordon Davis, all of Suffolk, United Kingdom

[73] Assignee: British Telecommunications Public Limited Company, London, United Kingdom

[21] Appl. No.: 08/078,245

[22] PCT Filed: Dec. 20, 1991

[86] PCT No.: PCT/GB91/02291

§ 371 Date: Jul. 27, 1993

§ 102(e) Date: Jul. 27, 1993

[87] PCT Pub. No.: WO92/11627

PCT Pub. Date: Jul. 9, 1992

[30] Foreign Application Priority Data

| | | | |
|---|---|---|---|
| Aug. 23, 1991 | [GB] | United Kingdom | 9118214 |
| Dec. 21, 1991 | [GB] | United Kingdom | 9027757 |

[51] Int. Cl.[7] ..... G10L 9/14

[52] U.S. Cl. ..... 704/220; 704/223

[58] Field of Search ..... 381/48–51; 395/2.1, 395/2.29, 2.67, 36, 40, 48–51, 2.3, 2.32; 704/201, 221–223, 219, 220, 258

[56] References Cited

U.S. PATENT DOCUMENTS

| | | | |
|---|---|---|---|
| 3,909,533 | 9/1975 | Willimann | 395/2.7 |
| 4,787,057 | 11/1988 | Hammond . | |
| 4,868,867 | 9/1989 | Davidson et al. | 381/36 |
| 4,932,061 | 6/1990 | Kroon et al. | 395/2.32 |
| 5,179,594 | 1/1993 | Yip et al. | 381/40 |
| 5,187,745 | 2/1993 | Yip et al. | 381/36 |
| 5,323,486 | 6/1994 | Taniguchi et al. | 395/2.31 |
| 5,371,853 | 12/1994 | Kao et al. | 395/2.32 |

FOREIGN PATENT DOCUMENTS

| | | |
|---|---|---|
| 0347307 | 12/1989 | European Pat. Off. . |
| 0424121 | 4/1991 | European Pat. Off. . |

OTHER PUBLICATIONS

Lever et al, "RPCELP: A High Quality and Low Complexity Scheme for Narrow Band Coding for Speech", EUROCON 88, 8th European Conference on Electrotechnics, Stockholm, Jun. 13–17, 1988, pp. 24–27, IEEE, New York, US.

Kleijn et al, "An Efficient Stochastically Excited Linear Predictive Coding Algorithm For High Quality Low Bit Rate Transmission of Speech", *Speech Communication*, vol. 7, No. 3, Oct. 1988, pp. 305–316, Elsevier Science Publishers B.V. (North–Holland), Amsterdam, NL.

Davidson et al, "Real–Time Vector Excitation Coding of Speech at 4800 BPS", ICASSP '87, 1987 International Conference om Acoustics, Speech, and Signal Processing, Dallas, Texas, Apr. 6–9, 1987, vol. 4, pp. 2189–2192, IEEE, New York, US.

(List continued on next page.)

*Primary Examiner*—David D. Knepper
*Attorney, Agent, or Firm*—Nixon & Vanderhye, P.C.

[57] ABSTRACT

A codebook excited speech coder analyzes speech to produce coefficients of a synthesis filter, the parameters of a long-term prediction filter (LTP) and a codeword indication one of a set of excitations. The results are transmitted to a receiver where they can be used to resynthesize the speech. The LTP and excitation analysis involve generation of impulse response products by adding additional terms to products already formed and storing them in a store. Multiplication of these products by excitation terms is performed using a pointer table storing precalculated addresses of locations in the store. If some excitations are shifted versions of others, some addresses can be obtained by modifying other addresses. The LTP analysis may include selection between a simple delay prediction and a prediction including the sum of two differently delayed terms, to provide improved predictor delay resolution.

5 Claims, 7 Drawing Sheets

OTHER PUBLICATIONS

Adoul et al, "Fast CELP Coding Based on Algebraic Codes", ICASSP '87, 1987 International Conference on Acoustics, Speech, and Signal Processing, Dallas, Texas, Apr. 6–9, 1987, vol. 4, pp. 1957–1960, IEEE, New York, US.

Muller, "Improving Performance of Code Excited LPC–Coders by Joint Optimization", Speech Communication, vol. 8, No. 4, Dec. 1989, pp. 363–360, Elsevier Science Publishers B.V. (North–Holland), Amsterdam, NL.

Jayant et al, "Speech Coding with Time–Varying Bit Allocation to Excitation and LPC Parameters", ICASSP '89, 1989 International Conference on Acoustics, Speech and Signal Processing, Glasgow, May 23–26, 1989, vol. 1, pp. 65–68, IEEE, New York, US.

Bergstrom et al, "Code–Book Driven Glottal Pulse Analysis", ICASSP '89, 1989 International Conference on Acoustics, Speech and Signal Processing, Glasgow, May 23–26, 1989, vol. 1, pp. 53–56, IEEE, New York, US.

Menez et al, "A 2 ms–Delay Adaptive Code Excited Linear Predictive Coder", ICASSP '90, 1990 International Conference on Acoustics, Speech and Signal Processing, Albuquerque, New Mexico, Apr. 3–6, 1990, vol. 1, pp. 457–460, IEEE, New York, US.

"Pitch Prediction With Fractional Delays in CELP Coding", J.S. Marques, J.M. Tribolet, I.M. Trancoso, L.V. Almeida, EuroSpeech, 1989, pp. 509–512.

"Strategies for Improving the Performance of CELP Coders at Low Bit Rates", P. Kroon and B.S. Atai, ICASSP–88, vol. 1, pp. 151–154, 1988 (IEEE).

Proceedings of the 1988 International Conference on Parallel Processing, Aug. 15–19, 1988, vol. III, The Pennsylvania State University Press, University Park, USA; S.T. Peng et al.: A New VLSI 2–D Systolic Array For Matrix Multiplication and Its Applications:, pp. 169–172.

ICASSP 89 (1989 International Conference on Acoustics, Speech and Signal Processing, May 23–26, 1992, Glasgow, GB) vol. 1, IEEE, New York, US; Cellario et al.: "A 2 MS Delay CELP Coder", pp. 73–76.

GENERATING THE VARIABLE CONTROL PARAMETERS OF A SPEECH SIGNAL SYNTHESIS FILTER

BACKGROUND OF THE INVENTION

1. Field of the Invention

The present application relates to methods and apparatus for the coding of speech signals; particularly (though not exclusively) to code excited linear predictive coding (LPC) in which input speech is analysed to derive the parameters of an appropriate time-varying synthesis filter, and to select from a "codebook" of excitation signals those which, when (after appropriate scaling) supplied in succession to such a synthesis filter, produce the best approximation to the original speech. The filter parameters, codeword identifying codebook entries, and gains, can be sent to a receiver where they are used to synthesise received speech.

2. Related Art

Commonly in such systems a long-term predictor is employed in addition to the LPC filter. This is best illustrated by reference to FIG. 1 of the accompanying drawings, which shows a block diagram of a decoder. The coded signal includes a codeword identifying one of a number of stored excitation pulse sequences and a gain value; the codeword is employed at the decoder to read out the identified sequence from a codebook store 1, which is then multiplied by the gain value in a multiplier 2. Rather than being used directly to drive a synthesis filter, this signal is then added in an adder 3 to a predicted signal to form the desired composition excitation signal. The predicted signal is obtained by feeding back past values of the composite excitation via a variable delay line 4 and a multiplier 5, controlled by a delay parameter and further gain value included in the coded signal. Finally the composite excitation drives an LPC filter 6 having variable coefficients. The rationale behind the use of the long term predictor is to exploit the inherent periodicity of the required excitation (at least during voiced speech); an earlier portion of the excitation forms a prediction to which the codebook excitation is added. This reduces the amount of information that the codebook excitation has to carry, viz it carries information about changes to the excitation rather than its absolute value.

One difficulty with the apparatus of FIG. 1 is that the temporal resolution of the long term predictor is limited to an integer multiple of the sampling rate.

One prior proposal for alleviating this difficulty involves upsampling the speech signals prior to long-term prediction to increase the resolution of the prediction delay parameter, which however increases the complexity of the apparatus. Another approach is to provide the delay 4 with several taps, each with its own gain factor, a combination of gain factors being chosen from a codebook of gain combinations. This however involves a lengthy search procedure since each delay/gain combination must be tested in the coder to determine the optimum combination.

BRIEF SUMMARY OF THE INVENTION

According to the preset invention a method of speech coding is provided in which input speech is analyzed to determine the parameters of a synthesis filter and to determine parameters of an excitation signal which can be applied at a decoder to a filter having the determined filter parameters to produce an output resembling the input speech. The exemplary embodiment includes the steps or:

a. determining the parameters of a predictor for producing from a past excitation signal a part a excitation which would produce from the filter a signal resembling the input speech;

b. determining a further excitation component which when added to the partial excitation produces a total excitation which would produce from the filter a signal better resembling the input speech; and c. determining the predictor parameter (i) producing (a) partial excitations each consisting of single past excitation samples delayed by a respective amount and (b) partial excitations each consisting of samples formed by weighted addition of at least two past excitation samples delayed by a respective amount;

(ii) calculating the difference between the input speech and the response of the filter to each partial excitation, the partial excitation being scaled to minimise the said difference, and selecting that partial excitation producing the smallest difference;

the predictor parameters being a delay signal, a signal indicating whether single or added past samples are employed, and a scaling factor.

Additionally, in code-excited LPC systems, substantial processing of the signals is required in order to identify the relevant codebook entry. With a view to improving the speed of such processing, the invention includes in further aspects:

(A) A method of speech coding in which input speech is analysed to determine the parameters of a synthesis filter and to select at least one excitation component from a plurality of possible components, including the step of determining the scalar product of the response of the filter to an excitation component and the response of the filter to the same or another excitation component, wherein the product of a filter response matrix H and its transpose $H^T$ to form a product matrix $H^TH$ is formed once, and each scalar product is formed by multiplying the product matrix by the relevant possible excitation components, characterised in that for each set of diagonal terms of the product matrix, a first member of the set is calculated, and each further member of that set is obtained by adding a further term to the preceding member of the set.

(B) A speech coding apparatus including (a) apparatus for analysing an input speech signal to determine the parameters of a synthesis filter; and (b) apparatus for selecting at least one excitation component from a plurality of possible components by determining the scalar product of the response of the filter to an excitation component and the response of the filter to the same or another excitation component, including means for forming the product of a filter response matrix H and its transpose $H^T$ to form a product matrix $H^TH$, including (c) a first store for storing elements of the product matrix $H^TH$;

(d) a second store storing, for each possible pair of an excitation component and the same or another excitation component, the address of each location in the first store which contains an element of the product matrix which is to be multiplied by nonzero elements of both excitation components of the pair; and (e) apparatus operable to retrieve addresses from the second store, to retrieve the contents of the locations in the first store thereby addressed, and to add the retrieved contents.

(C) A speech coding apparatus including (a) apparatus for analysing an input speech signal to determine the parameters of a synthesis filter; and (b) means for selecting at least one excitation component from a plurality of possible components by determining the scalar product of the response of the filter to an excitation component and the response of the filter to the same or another excitation component, including apparatus for forming the product of a filter response matrix H and its transpose $H^T$ to form a product matrix $H^TH$; wherein the plurality of possible components consists of a plurality of subsets of components, each component of a subset being a shifted version of another member of the same subset, and the selecting includes (c) a first store for storing elements of the product matrix $H^TH$;

(d) a second store storing, for one representative component of each subset of excitation components, the addresses of each location in the first store which contains an element of the product matrix which is to be multiplied by nonzero elements of the representative component; and (e) apparatus operable to retrieve addresses from the second store, to modify the addresses in respect of components other than the representative components, to retrieve the contents of the location in the first store thereby addressed, and to add the retrieved contents.

The invention also includes apparatus for implementing the methods mentioned above.

BRIEF DESCRIPTION OF THE DRAWINGS

Some embodiments of the invention will now be described, by way of example, with reference to the accompanying drawings, in which.

DETAILED DESCRIPTION OF EXEMPLARY EMBODIMENTS OF THE INVENTION

Figure 1:
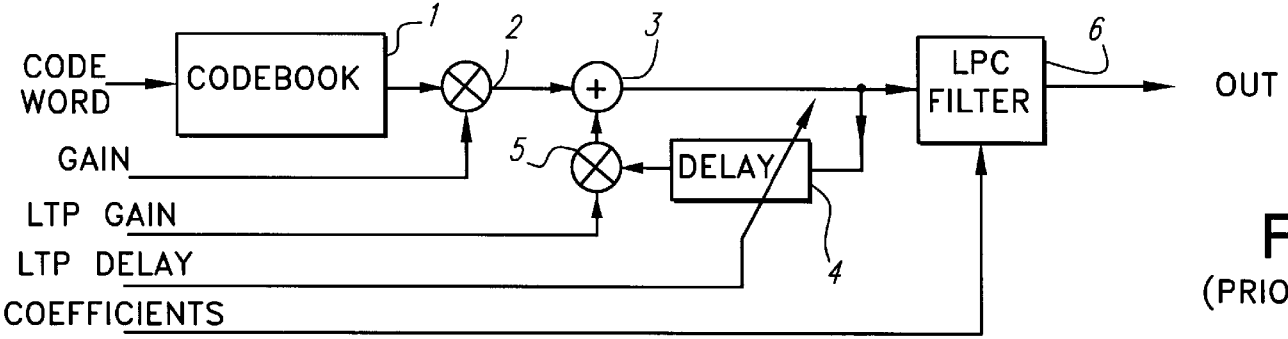
Fig.1 (PRIOR ART)
FIG. 1 is a block diagram of a prior art long term predictor.
Figure 2:
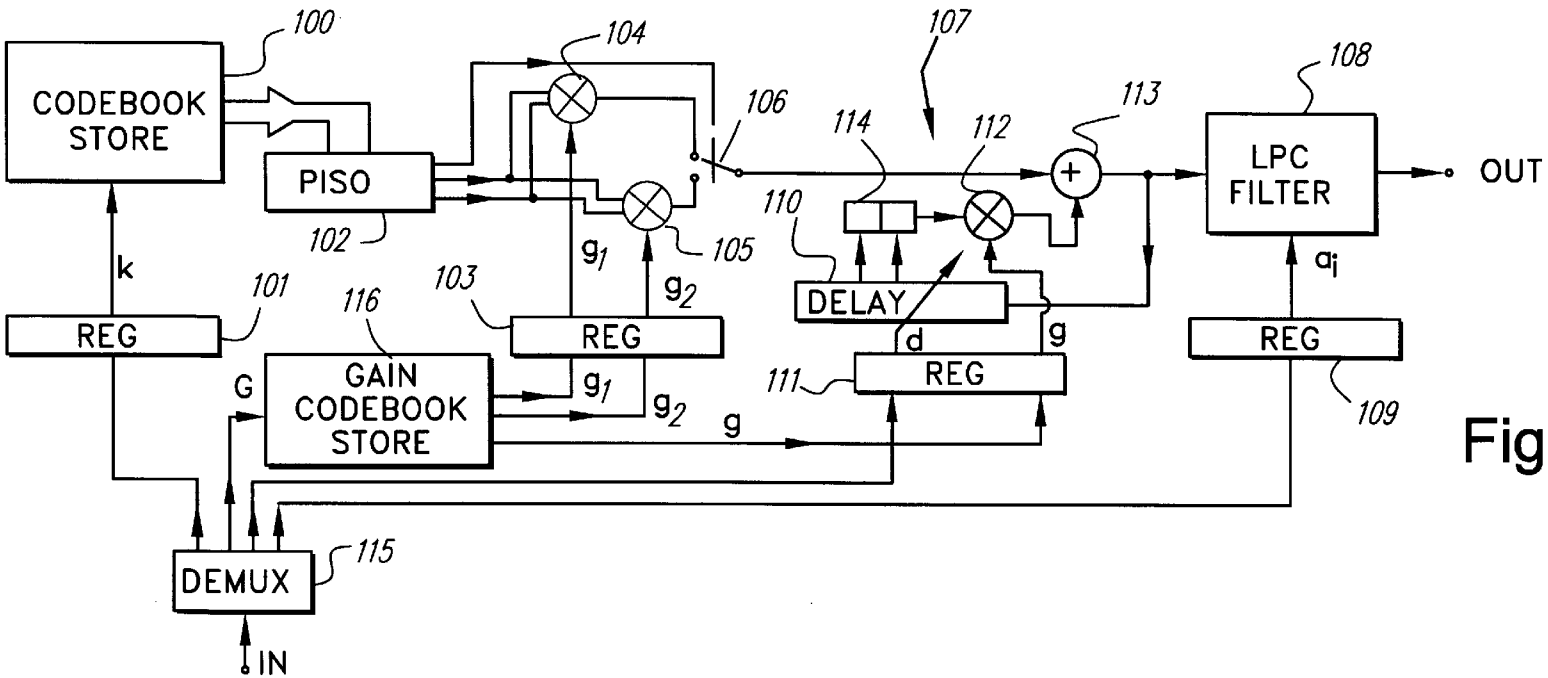
FIG. 2 is a block diagram of a decoder to be used with coders according to the invention.

Before describing the speech coder, we first describe with reference to FIG. 2, a decoder to illustrate the manner in which the coded signals are used upon receipt to synthesise a speech signal. The basic structure involves the generation of an excitation signal, which is then filtered.

The filter parameters are changed once every 20 ms; a 20 ms period of the excitation signal being referred to as a block; however the block is assembled from shorter segments ("sub-blocks") of duration 5 ms.

Every 5 ms the decoder receives a codebook entry code k, and two gain values $g_1$, $g_2$ (though only one, or more than two, gain values maybe used if desired). It has a codebook store 100 containing a number (typically 128) of entries each of which defines a 5 ms period of excitation at a sampling rate of 8 kHz. The excitation is a ternary signal (i.e. may take values +1, 0 or −1 at each 125 $\mu$s sampling instant) and each entry contains 40 elements of three bits each, two of which define the amplitude value. If a sparse codebook (i.e. where each entry has a relatively small number of nonzero elements) is used a more compressed representation might however be used.

The code k from an input register 101 is applied as an address to the store 100 to read out an entry into a 3-bit wide parallel-in-serial out register 102. The output of this register (at 8 k/samples per second) is then multiplied by one or other of the gains $g_1$, $g_2$ from a further input register 103 by multipliers 104, 105; which gain is used for a given sample is determined by the third bit of the relevant stored element, as illustrated schematically by a changeover switch 106.

The filtering is performed in two stages, firstly by a long term predictor (LTP) indicated generally by reference numeral 107, and then by an LPC (linear predictive coding) filter 108. The LPC filter, of conventional construction, is updated at 20 ms intervals with coefficients a from an input register 109.

The long term filter is a "single tap" predictor having a variable delay (delay line 110) controlled by signals d from an input register 111 and variable feedback gain (multiplier 112) controlled by a gain value g from the register 111. An adder 113 forms the sum of the filter input and the delayed scaled signal from the multiplier 112. Although referred to as "single tap" the delay line actually has two outputs one sample period delay apart, with a linear interpolator 114 to form (when required) the average of the two values, thereby providing an effective delay resolution of ½ sample period.

The parameters k, $g_1$, $g_2$, d, g and a, are derived from a multiplexed input signal by means of a demultiplexer 115. However, the gains $g_1$, $g_2$ and g are identified by a single codeword G which is used to look up a gain combination from a gain codebook store 116 containing 128 such entries.

Figure 3:
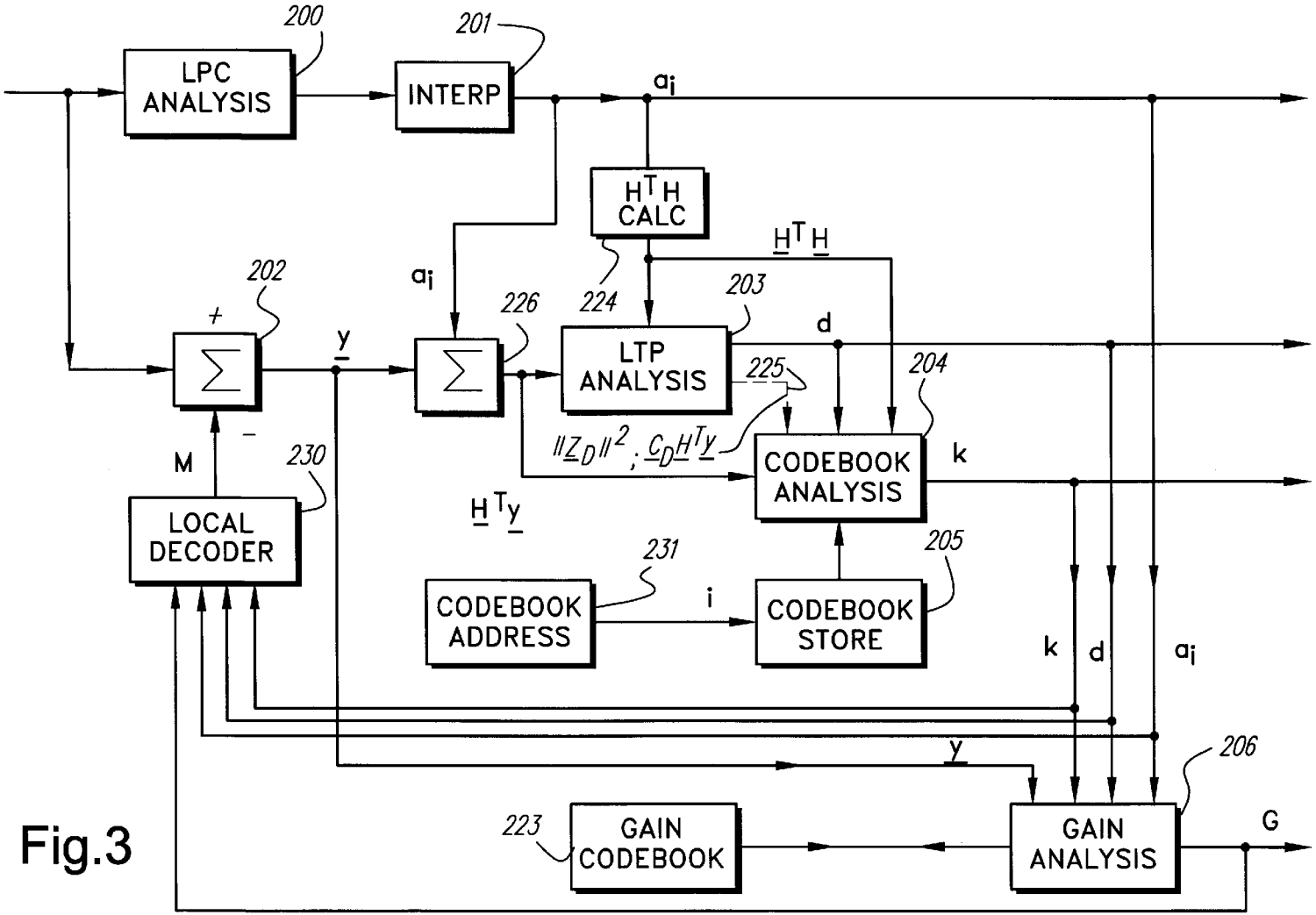
FIG. 3 is a block diagram of a speech, coder of accordance with one embodiment of the invention.

The task of the coder is to generate, from input speech, the parameters referred to above. The general architecture of the coder is shown in FIG. 3. The input speech is divided into frames of digital samples and each frame is analysed by an LPC analysis unit 200 to derive the coefficients a of an LPC filter (impulse response h) having a spectral response similar to that of each 20 ms block of input speech. Such analysis is conventional and will not be described further; it is however worth noting that such filters commonly have a recursive structure and the impulse response h is (theoretically) infinite in length.

The remainder of the processing is performed on a sub-block by sub-block basis. Preferably the LPC coefficient values used in this process are obtained by LSP (line spectral pair) interpolation between the calculated coefficients for the preceding frame and those for the current frame. Since the latter are not available until the end of the frame this results in considerable system delay; a good compromise is to use the 'previous block' coefficients for the first half of the frame (i.e. in this example, the first two sub-blocks) and interpolated coefficients for the second half (i.e. the third and fourth sub-blocks). The forwarding and interpolation is performed by an interpolation unit 201.

The input speech sub-block and the LPC coefficients for that sub-block are then processed to evaluate the other parameters. First, however, the decoder LPC filter, due to the length of its impulse response, will produce for a given sub-block an output in the absence of any input to the filter. This output—the filter memory M—is generated by a local decoder 230 and subtracted from the input speech in a subtractor 202 to produce a target speech signal y. Note that this adjustment does not include any memory contribution from the long term predictor as its new delay is not yet known.

Secondly, this target signal y and the LPC coefficients a, are used in a first analysis unit 203 to find that LTP delay d which produces in a local decoder with optimal LTP gain g and zero excitation a speech signal with minimum difference from the target.

Thirdly, the target signal, coefficients a and delay d are used by a second analysis unit 204 to select an entry from a codebook store 205 having the same contents as the decoder store 100, and the gain values $g_1$, $g_2$ to be applied to it.

Finally, the gains g, $g_1$, $g_2$ are jointly selected to minimise the difference between a local decoder output and the speech input.

Looking in more detail at the first analysis unit 203, this models (FIG. 4) a truncated local decoder having a delay line 206, interpolator 207, multiplier 208 and LPC filter 209 identical to components 110, 112, 114 and 108 of FIG. 2. The contents of the delay line and the LPC filter coefficients are set up so as to be the same as the contents of the decoder delay line and LRC filter at the commencement of the sub-block under consideration. Also shown is a subtractor 210 which forms the difference between the target signal y and the output gX of the LPC filter 209 to form a mean square error signal $e^2$. X is a vector representing the first n samples of a filtered version of the content of the delay line shifted by the (as yet undetermined) integer delay d or (if interpolation is involved) of the mean of the delay line contents shifted by delays d and d+1. The value d will be supposed to have an additional bit to indicate switching between integer delay prediction (with tap weights (0,1) and "half step" prediction with tap weights (½,½). y is an n element vector. n is the number of samples per sub-block—40, in this example. Vectors are, in the matrix analysis used, column vectors—row vectors are shown as the transpose, e.g. "$y^T$".

The error is:

$$e^2 = \|\underline{y} - g\underline{X}\|^2 = (\underline{y} - g\underline{X})^T(\underline{y} - g\underline{X}) \tag{1}$$

$$= \underline{y}^T\underline{y} - g\underline{X}^T\underline{y} - g\underline{y}^T\underline{X} + g^2\underline{X}^T\underline{X} \tag{2}$$

$$= \underline{y}^T\underline{y} - 2g\underline{X}^T\underline{y} + g^2\underline{X}^T\underline{X} \tag{3}$$

To minimise this error we set the differential with respect to g to zero. (Where g' denotes the optimum value of g at this stage).

$$\frac{d(e^2)}{dg} = -2\underline{X}^T\underline{y} + 2g\underline{X}^T\underline{X} = 0 \tag{4}$$

$$g'\underline{X}^T\underline{X} = \underline{X}^T\underline{y} \tag{5}$$

$$\text{and } g' = (\underline{X}^T\underline{X})^{-1}\underline{X}^T\underline{y} \tag{6}$$

Substituting in (3)

$$e^2 = y^Ty - y^1X(X^1X)^{-1}X^Ty \tag{7}$$

gives the mean square error for optimum gain.

If the delay line output for a delay d is D(d), then $$X = H\,D(d) \tag{8}$$

and the second term of equation (7) can be written.

$$y^TH\,D(d)\,[D(d)^TH^TH\,D(d)]D(d)^TH^Ty \tag{9}$$

The delay d is found by computing (control unit 211) the second term in equation (7) for each of a series of trial values of d, and selecting that value of d which gives the largest value of that term (see, below, however, for a modification of this procedure). Note that, although apparently a recursive filter, it is more realistic to regard the delay line as being an "adaptive codebook" of excitations. If the smallest trial value of d is less than the sub-block length then one would expect that the new output from the adder 113 of the decoder would be fed back and appear again at the input of the multiplier. (In fact, it is preferred not to do this but to repeat samples. For example, if the sub-block length is s, then the latest d samples would be used for excitation, followed by the oldest s-d of these). The value of the gain g is found from eq 6.

Returning to FIG. 3, the second analysis unit 204 serves to select the codebook entry. An address generator 231 accesses, in sequence, each of the entries in the codebook store 205 for evaluation by the analysis unit 204. The actual excitation at the decoder is the selected entry selectively multiplied by the gains $g_1$, $g_2$ (or, more generally, $g_1$, $g_2$ . . . $g_{e-1}$ where m is the total number of gains including the long term predictor gain g; the mathematics quoted below assumes m=3). the entry can be through of as being the sum of m−1 partial entries—each containing the nor-zero elements to be multiplied by the relevant gain with zeros for the elements to be subjected to a different gain—each multiplied by a respective gain. The entry is selected by finding, for each entry, the mean squared error—at optimum gain—between the output of a local decoder and the target signal y.

Suppose the partial entries are $C_1$, $C_2$ and the selected LTP delay gives an output $C_0$ from the delay line.

The total input to the LPC filter is $$g_1C_1 + g_2C_2 + g\,C_0 \tag{10}$$

And the filter output is $$g_1H\,C_1 + g_2H\,C_2 + g\,H\,C_0 \tag{11}$$

Where H is a convolution matrix consisting of the impulse response $h^T$ and shifted versions thereof.

If the products H $C_1$, H $C_2$, H $C_0$ are written as $Z_{i1}$, $Z_{i2}$, $Z_0$ where i is in the codebook entry, and $(g_1, g_2, g)^T$=g then the decoder output is $$\underline{Z}_{ij}\cdot g = [\,\underline{Z}_{i1}\;\;\underline{Z}_{i2}\;\;\underline{Z}_D\,]\begin{bmatrix} g_1 \\ g_2 \\ g \end{bmatrix} \tag{12}$$

$Z_{il}$ is a n×m matrix where n is the number of samples and m the total number of gains.

Thus the mean squared error is $$e^2 = \|v - Z_{ij}g\|^2 \tag{13}$$

By the same analysis as given in equations (1) to (7) setting the derivative with respect to g to zero gives an optimum gain of $$g = (Z_{ij}^TZ_{ij})^{-1}z_{ij}^Ty \tag{14}$$

and substituting this into equation 13 gives an error of $$e^2 = y^Ty = v^TZ_{ij}\,(Z_{ij}^TZ_{ij})^{-1}Z_{ij}^Ty \tag{15}$$

And hence a need to choose the codebook entry to maximise:

$$y^TZ_{ij}\,(Z_{ij}^TZ_{ij})^{-1}Z_{ij}^Ty \tag{16}$$

Figure 5:
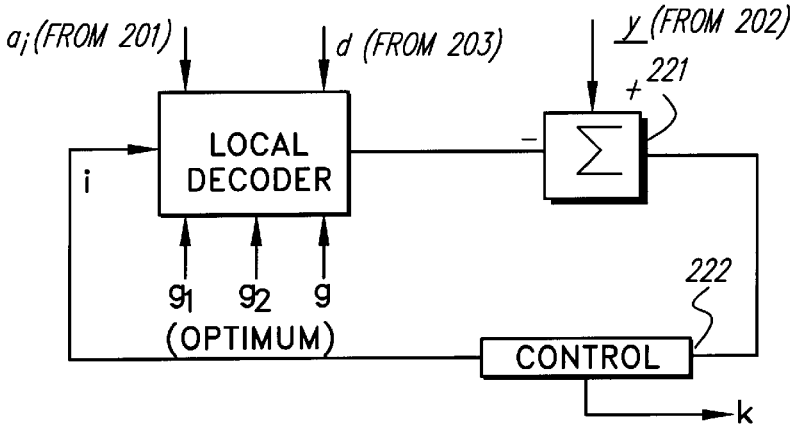

This process is illustrated by the diagram of FIG. 5 where a local decoder 220, having the structure shown in FIG. 2, produces an error signal in a subtractor 221 for each trial i and a control unit 222 selects that entry (i.e. entry k) giving the best result. Note particularly that this process does not presuppose the previous optimum value g' assumed by the analysis unit 203. Rather, it assumes that g (and g1, g2 etc) has the optimum value for each of the candidate excitation entries.

Figure 6:
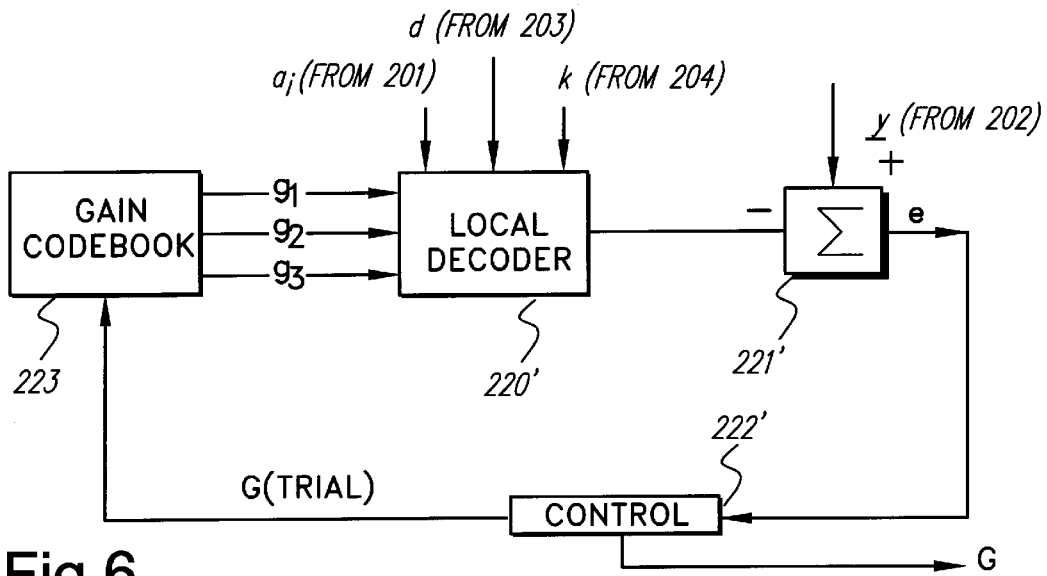

The operation of the gain analysis unit 206, illustrated in FIG. 6, is similar (similar components having reference numerals with a prime (') added), but involves a vector quantisation of the gains. That gain codeword G is selected for output which addresses that combination of gains from a gain codebook store 223 (also shown in FIG. 3) which produces the smallest error $e^2$ from the subtractor 221'. The store 223 had the same contents as the decoder store 116 of FIG. 2.

Figure 4:
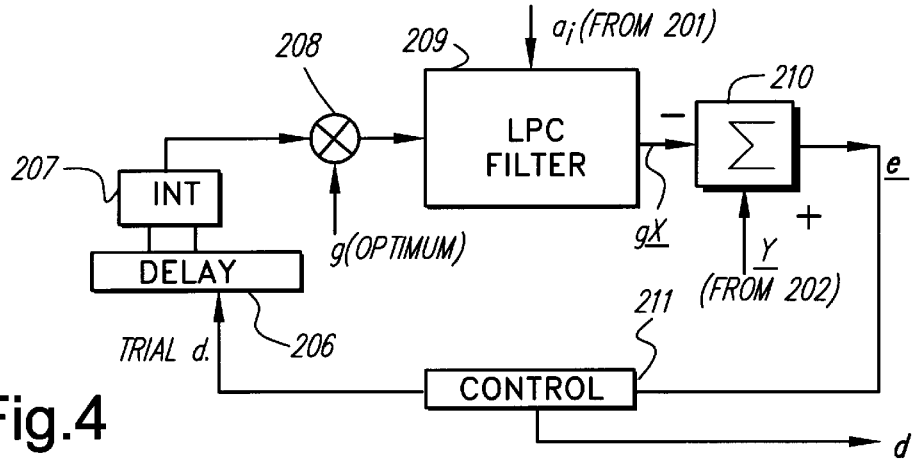
FIG. 4, 5 and 6 are diagrams illustrating operation of parts of the coder of FIG. 3.
Figure 10:
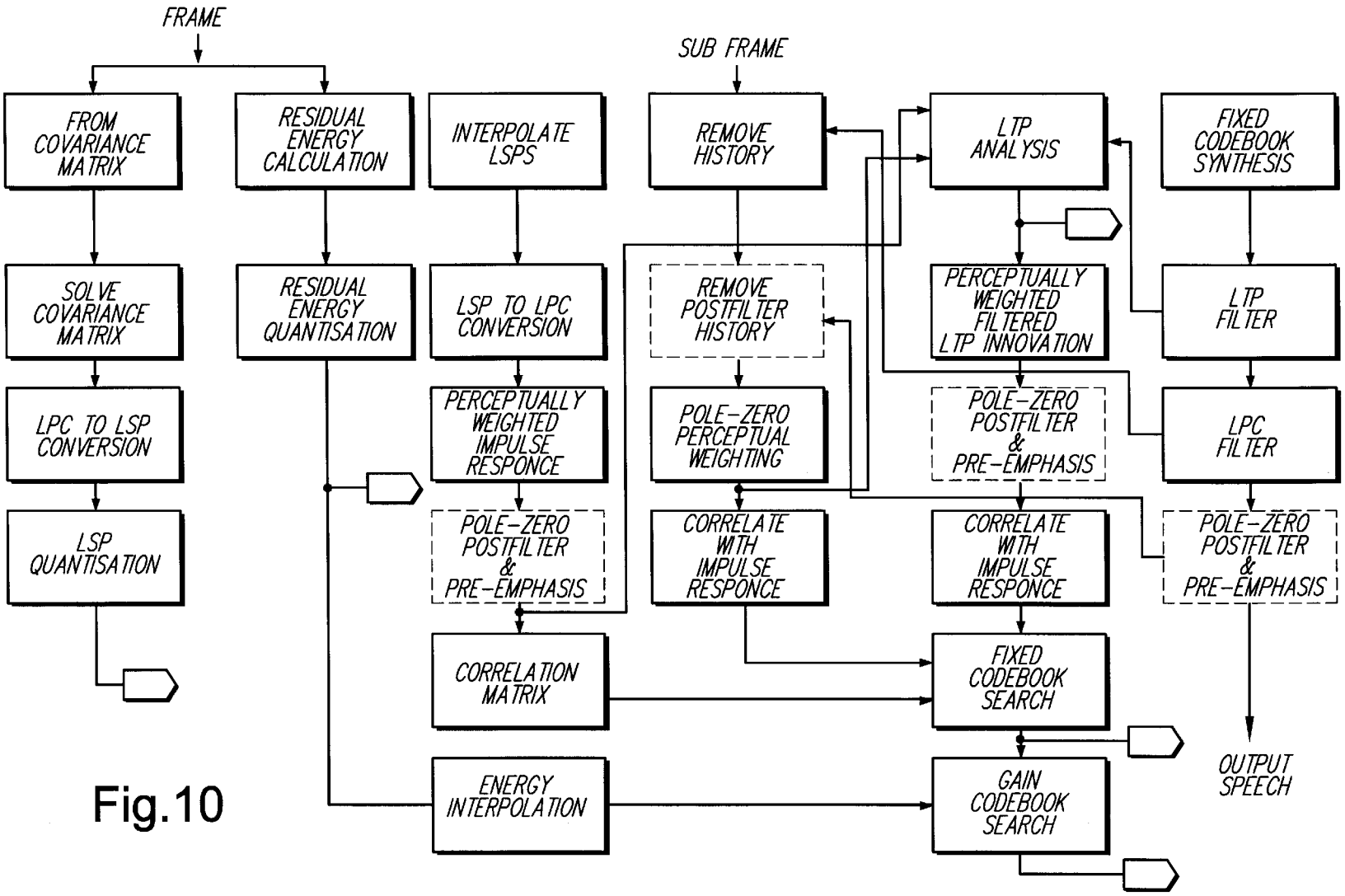
FIG. 10 is a flowchart showing the overall operation of the coders.

It should be noted that FIGS. 4, 5 and 6 are shown for illustrative purposes; in practice the derivations performed by the analysis units 203, 204, 206 may be more effectively performed by a suitably programmed digital signal processing (DSP) device. flowcharts for the operation of such devices are presented in FIG. 10. Firstly, however we describe a number of measures which serve to reduce the complexity of the computation which needs to be carried out.

(a) Consider the product $Z_{ij}^T Z_{ij}$ of expression

(16) This is a 3×3 symmetric matrix:

$$\begin{bmatrix} \|Z_{i1}\|^2 & Z_{i1}^T Z_{i2} & Z_{i1}^T Z_D \\ Z_{i2}^T Z_{i1} & \|Z_{i2}\|^2 & Z_{i2}^T Z_D \\ Z_D^T Z_{i1} & Z_D^T Z_{i2} & \|Z_D\|^2 \end{bmatrix} \tag{17}$$

Each term of this is a product of the form $Z_a^T Z_b$ where a, b are any of i1, i2, D and can be written as $$Z_a^T Z_b = (H\,C_a)^T H\,C_b = C_a^T H^T H\,C_b \tag{18}$$

A similar term is present also in expression (9) for the LTP search. $H^T H$ can be precalculated as it remains constant for the LTP and excitation search. In FIG. 3 this calculation is shown as performed in a calculation unit 224 feeding both analysis units 203, 204. Note that the diagonals of the $H^T H$ matrix are the same sum with increasing limits, so that successive elements can be calculated by adding one term to an element already calculated. This is illustrated below with H shown as a 3×3 matrix, although in practice of course it would be larger: the size of H would be chosen to alive a reasonable approximation to the conventionally infinite impulse response.

$$\text{If } \underline{H} = \begin{bmatrix} h_1 & 0 & 0 \\ h_2 & h_1 & 0 \\ h_3 & h_2 & h_1 \end{bmatrix}$$

Then $$\underline{H}^T \underline{H} = \begin{bmatrix} h_1 & h_2 & h_3 \\ 0 & h_1 & h_2 \\ 0 & 0 & h_1 \end{bmatrix} \begin{bmatrix} h_1 & 0 & 0 \\ h_2 & h_1 & 0 \\ h_3 & h_2 & h_1 \end{bmatrix}$$

-continued $$= \begin{bmatrix} \sum_{i=1}^{3} h_i^2 & \sum_{i=1}^{2} h_i h_{i+1} & \sum_{i=1}^{1} h_i h_{i+2} \\ \sum_{i=1}^{2} h_i h_{i+1} & \sum_{i=1}^{2} h_i^2 & \sum_{i=1}^{1} h_i h_{i+1} \\ \sum_{i=1}^{1} h_i h_{i+2} & \sum_{i=1}^{1} h_i h_{i+1} & \sum_{i=1}^{1} h_i^2 \end{bmatrix}$$

from which, it can be seen that each of the higher elements can be obtained by adding a further term to the element diagonally below it to the right.

Thus, if each term of the $H^T H$ matrix is $H_{ij}$ (for the i'th row and j'th column) then, for example $H_{23} \leqq h_1\ h_2$ $H_{12} = H_{23} + h_2 H_2$ Also since $H_{ij} = H_{ji}$ (i*j) each of these pairs of terms can each be calculated only once and then multiplied by 2.

Figure 7:
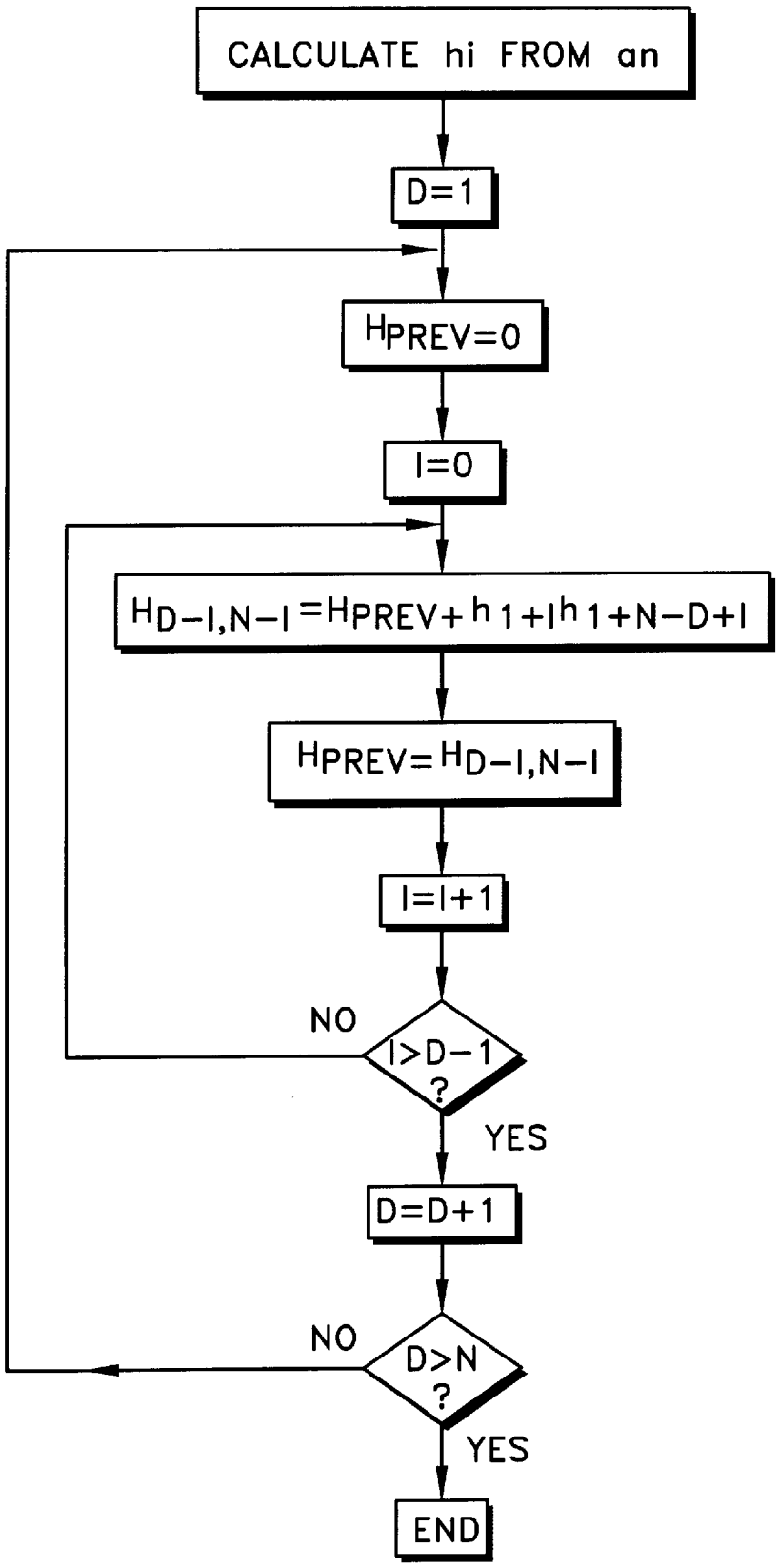
FIG. 7 is a flowchart demonstrating part of the operation of unit 224 of FIG. 3.

This process is further illustrated in the flowchart of FIG. 7 where the terms $H_{ij}$ (i=1 . . . N, j=1 . . . N), upwards on each diagonal D (D=1 being the top righthand corner of the matrix) are successively computed for each element after the lowest in position (for which the index I=0) by adding a further h. h. poduct term.

As C is ternary, finding $C_1\ H\ H^T C_i^T$ (for example) from the $H^1 H$ matrix simply amounts to selecting the appropriate elements from it (of appropriate sign) and adding them up.

Figure 8:
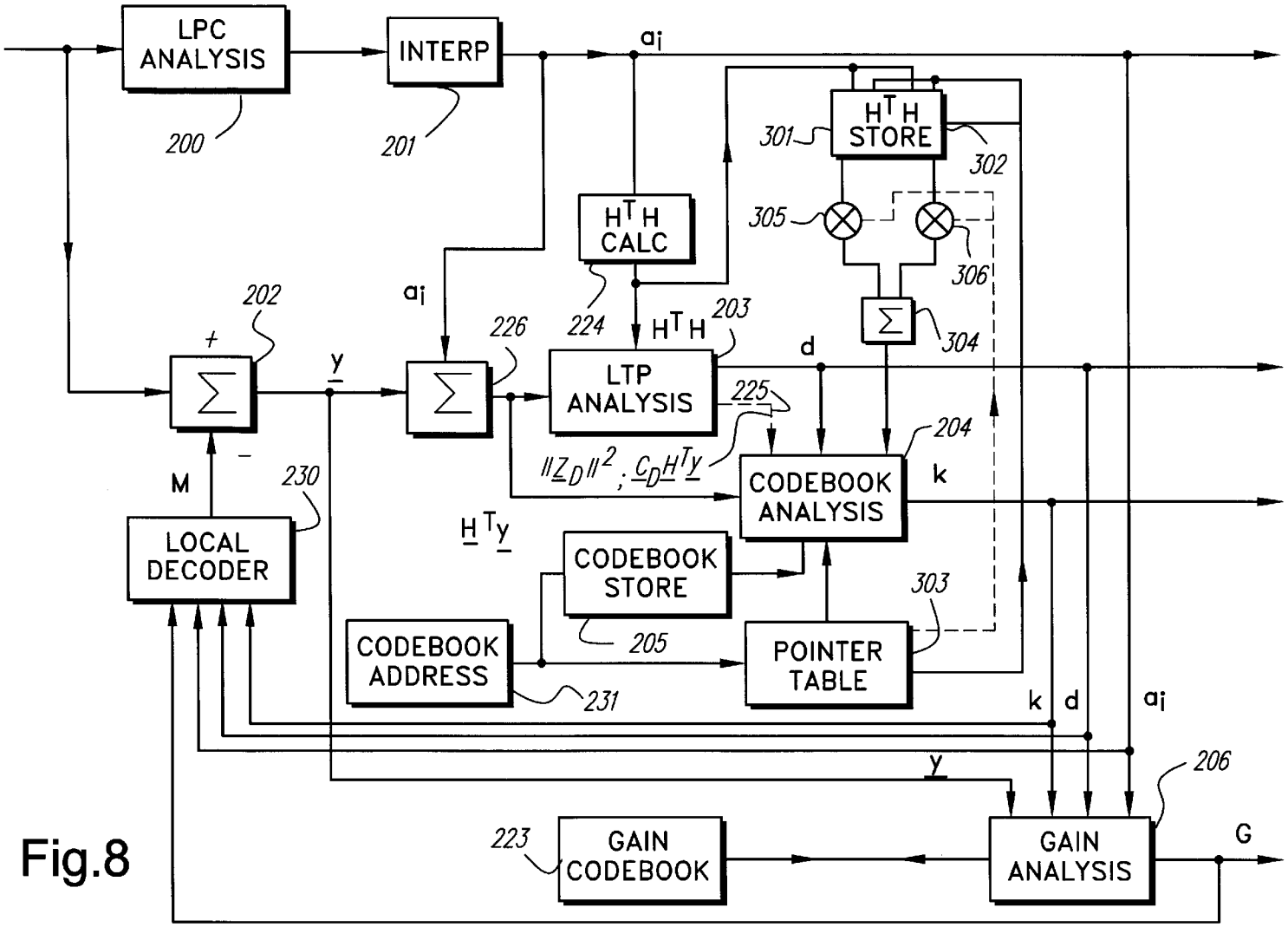
FIG. 8 is a second embodiment of speech coder according to the invention.
Figure 9:
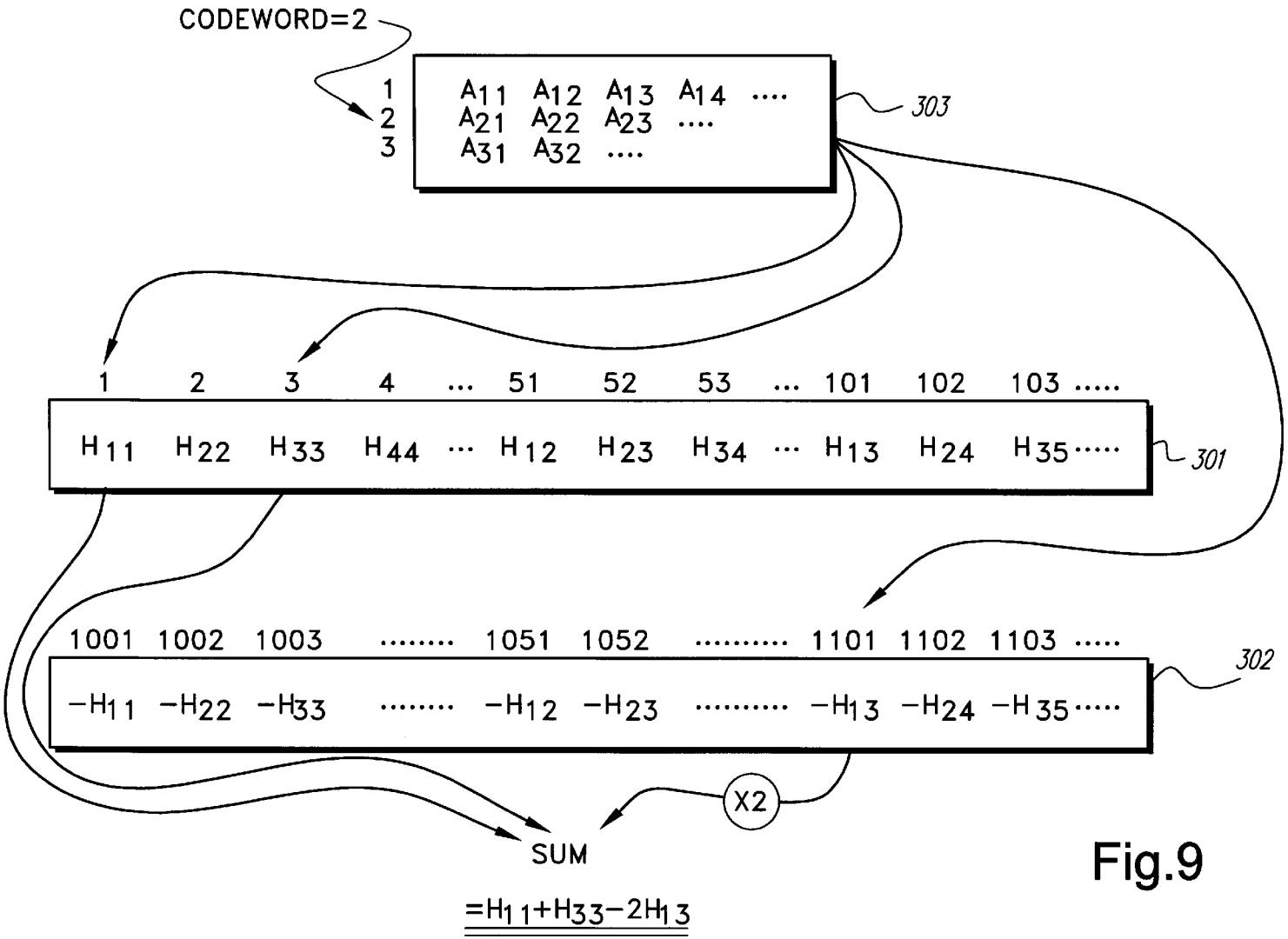
FIG. 9 is a diagrm illustrating the look-up process used in the coder of FIG. 8.

This can be performed by means of a pointer table arrangement, using the modified apparatus shown in FIG. 8. The elements of the $H^T$ matrix, calculated by the unit 224, are stored in a store 301; or rather—in view of the symmetry of the matrix—the elements on the leading diagonal along with the elements above (or below) the leading diagonal are stored. A second store 302 (in practice, part of the same physical store) stores the same elements but with negative values. Alongside the codebook store 205 is a pointer table 303 which stores, for each codebook entry, a list of the addresses of those locations within the stores 301,302 which contain the required elements. This process is illustrated schematically in FIG. 9 where the stores 301, 302, 303 are represented by rectangles and the contents by $A_{11}$, etc. (where $A_{ij}$ is the j'th member of the address list for codeword i and $H_{11}$ etc. are as defined above. The actual contents will be binary numbers representing the actual values of these quantities. The addresses are indicated by numbers external to the rectangles.

Suppose, by way of example, that the codeword no. 2 represents an excitation (−1,0,1,0,0, . . . . ,0); then the desired elements of the $H^T H$ matrix are $(+)H_{11}$,$(+)H_{33}$,$-H_{31}$, $-H_{13}$. Therefore the relevant addresses are:

$A_{21}=1$ $A_{22}=3$ $A_{23}=1101$ ($A_{24}=1101$)

Thus codeword 2 addresses the pointer table 303; the addresses $A_{21}$ etc. are read out and used to access the store 301/302; the contents thereby accessed are added together by an adder 304 to produce the required value $C^T H^T HC$. Since the elements off the leading diagonal always occur in pairs, in practice separate addresses would not be stored but the partial result multiplied by two (a simple binary shift) instead.

In a modification of this method, groups of excitations are shifted versions of one another; for example if excitation 3 is simply a one-place right-shift of excitation 2 (i.e. (0, −1, 0, 1 . .) in the above example, when the desired elements are $+H_{21}$, $+H_{44}$, $-H_{24}$, $-H_{42}$ and the addresses are:

$A_{21}=2$ $A_{32}=4$ $A_{32}=1102$ $(A_{34}=1102)$

Therefore, to avoid a fresh look-up access to the pointer table 303 the addresses found for codeword 2 can be simply be modified to provide the new addresses for codeword 3. With the addressing scheme of FIG. 9 where elements of a diagonal of the matrix occupy locations with consecutive addresses this merely requires incrementing of all the addresses by one. This scheme fails if a pulse is lost (or needs to be gained) in the shift; whilst it may be possible to accommodate lost pulses by suppressing out-of-range addresses. A fresh access to the pointer table is then required for each new group.

Since this modification involves a loss of "randomness" of the excitations it may be wise to allow the pulses to take a wider range of values – i.e. discard the "ternary pulse" restriction. In this case each pointer table entry would contain, as well as a set of addresses, a set of $C_{ij}$, $C_{ik}$ products ($C=\{C_{i1}, C_{i2}, \ldots\}$) by which the retrieved $H^TH$ elements would be multiplied. In FIG. 8 this is provided for by the multipliers 305, 306 and the dotted connections from the pointer table.

In the case of the upper right-hand terms $Z_{i1}{}^TZ_D$ and $Z_{i2}{}^TZ_D$, these are equal to and $C_1{}^T H^TH\, C_D$ and $C_2{}^TH^TH\, C_0$ respectively and since $C_0$ is fixed for the codebook search $H^TH\, C_0$ can be precalculated.

In the case of the $\|Z_D\|^2$ this is the term $X^TX$ already computed in the analysis unit 203 for the selected delay and is obtained from the latter via a path 225 in FIGS. 3 and 8.

(b) Consider now the term $$\underline{Z}_{ij}^T\underline{y} = \begin{bmatrix} \underline{Z}_{i1}^T \\ \underline{Z}_{i2}^T \\ \underline{Z}_D^T \end{bmatrix} \underline{y} = \begin{bmatrix} \underline{C}_1^T\underline{H}^T \\ \underline{C}_2^T\underline{H}^T \\ \underline{C}_D^T\underline{H}^T \end{bmatrix} \underline{y} \tag{19}$$

For $C_1{}^TH^Ty$ and $C_2{}^TH^Ty$, $H^Ty$ is precalculated both for the expressions (9) and (19) in a unit 226 in FIGS. 3 and 8. $C_D{}^TH^Ty$ available from the LTP search (via the path 225).

(c) The term $y^TZ_{ij}$ is just the transpose of $Z_{ij}{}^T$ y of course.

(d) Consider now the term $H^Ty$ (or its transpose $y^TH$), from (b) above. This is a cross-correlation between the target and impulse response H.

We note that the LPC filter is a recursive filter having an infinite impulse response. H is a 40×40 matrix representing an FIR approximation to this response. Evaluation of $H^Ty$ involves typically 800 multiplications and this would be extremely onerous.

In order to explain the proposed method for evaluating this quantity, it is necessary to define a new mathematical notation.

If A is a p×c matrix, then $A^R$ is a row and column mirror image of A.

$$A^R = \begin{bmatrix} a_{11} & a_{12} & a_{13} \\ a_{21} & a_{22} & a_{23} \end{bmatrix} \qquad R = \begin{bmatrix} a_{23} & a_{22} & a_{21} \\ a_{13} & a_{12} & a_{11} \end{bmatrix}$$

It follows that $A^RS=(AB^R)^R$ Consider now the vector $H^Ty$. Since H is symmetric, $H^t=H^R$, so $H^Ty=H^Ry=(H\ y^R)^R\ H\ y^R$ represents a 'time reversed' target signal y filtered by the response h and thus the correlation can be replaced by a convolution and implemented by a recursive filtering operation.

(e) Having discussed the individual parts of $$y^TZ_{ij}\ (Z_{ij}{}^T\ Z_{ij})^{-i}\ Z_{ij}{}^Ty$$

we now require to find the maximum value of this expression. In order to avoid the division by the determinant of $Z_{ij}{}^TZ_{ij}$ required for finding the inverse, we compute, separately, $$\text{Num}=\det[Z_{ij}{}^TZ_{ij}]y^TZ_{ij}\ (Z_{ij}{}^TZ_{ij})^{-1}Z_{ij}{}^Ty$$

$$\text{Den}=\det[Z_{ij}{}^T\ Z_{ij}]$$

The values $\text{Num}_{max}$ and $\text{Den}_{max}$ for the previous largest value are stored, and (default=0, 1). The test $$\text{Num/Den}>\text{Num}_{max}/\text{Den}_{max}?$$

is then performed as Num. $\text{Den}_{max}>\text{Num}_{max}$, Den?

In the modification discussed above employing excitations which are shifted versions of one another, the number of addresses that need to be retrieved from the pointer table store 303 is reduced, because addresses already retrieved can be modified. This presupposes that the codebook analysis unit 204 keeps all the addresses for a given codebook entry so that they are available to be modified for the next one, and therefore it will require local storage; for example if it is a digital signal processing chip its on-board registers may be used for this purpose. The number of addresses is p(p+1)/2 where p is the number of pulses in an excitation (assuming p is constant and truncation of H (see below) is not employed). If this exceeds the number of available registers, the problem can be alleviated by the use of "sub-vectors".

This proposal provides that each excitation of the codebook set is a concatenation of two (or more) partial excitations or sub-vectors belonging to a set of sub-vectors, viz:

$$\underline{C}_i = \begin{bmatrix} \underline{c}_{i1} \\ \underline{c}_{i2} \\ \underline{c}_{iu} \end{bmatrix}$$

where $c_{ij}$ is a sub-vector and u is the number of sub-vectors in an excitation. Necessarily each sub-vector occurs in a number of different excitations. The computation of $C^TH^THC$ terms can then be partitioned into $u^2$ partial results each of which involves the multiplication of a sub-block of the $H^TH$ matrix by the two relevant partial excitations. If the sub-block is $J_{f3}$ (r=1, . . . u; s=1, . . . u) so that:

$$\underline{H}^T\underline{H} = \begin{bmatrix} \underline{J}_{11} & \underline{J}_{12} & \cdots & \underline{J}_{1u} \\ \underline{J}_{21} & & & \cdots \\ \underline{J}_{u1} & & \cdots & \underline{J}_{uu} \end{bmatrix}$$

and $$\underline{J}_{rs} = \begin{bmatrix} H_{(r-1)\cdot\frac{N}{u}+1,(s-1)\cdot\frac{N}{u}+1} & H_{(r-1)\cdot\frac{N}{u}+1,(s-1)\cdot\frac{N}{u}+2} & \cdots & H_{(r-1)\cdot\frac{N}{u}+1,s\cdot\frac{N}{u}} \\ H_{r-1\cdot\frac{N}{u}+2,(s-1)\cdot\frac{N}{u}+1} & & \cdots & \\ \cdots & & & \\ H_{r\cdot\frac{N}{u},(s-1)\cdot\frac{N}{u}+1} & & \cdots & H_{r\cdot\frac{N}{u},s\cdot\frac{N}{u}} \end{bmatrix}$$

then the partial product as;

$$P_{r.3}=C_{ir}J_{rs}=C_{is}$$

and the final result is:

$$\underline{C}^T \underline{H}^T \underline{HC} = \sum_{r=1}^{u} \sum_{s=1}^{u} P_{r,s}$$

In this scheme, the partial excitations $C_{ij}$ (rather than the excitations $C_i$) are shifted versions of one another (within a group thereof). The sequence of operations is modified so that all the partial products $P_{f,5}$ involving given values of r and s are performed consecutively and the addresses corresponding to that pair are then modified to obtain the addresses for the next pair (with additional address retrieval if either $C_{if}$ or $C_{is}$ crosses a group boundary as i is incremented. Naturally there is an overhead in that the partial products need to be stored and, at the end of the process retrieved and combined to produce the final results.

As any given pair (of the same or different) sub-vectors in given positions r,s will occur in more than one $C_i$, the relevant partial product can be formed and stored once and retrieved several times for the relevant excitations $C_i$. (This is so whether or not "shifting" is used.

It is observed in practice that, since the later terms of the impulse response h tend to be fairly small, terms in the $H^TH$ matrix which relate to contributions from pulses of the excitation which are far apart—i.e. the terms in the upper right-hand corner and lower left-hand corner of (as set out on page 11 above)—are also small and can be assumed zero with little loss of accuracy. This can readily be achieved by omitting the corresponding addresses from the pointer table 203 and, of course, by the analysis unit 204 not retrieving them. The same logic may be applied to systems using sub-vectors. Where it is desired, for simplicity of address retrieval, that the number of pulses, and the number of addresses per codebook entry are always the same, it may be convenient to omit those K addresses (where K is the number desired to be omitted) which relate the furthest apart pulse pairs (or those pulse pairs which are furthest apart in terms of their number In the pulse sequence—as opposed to their positions in the frame—; a similar but not identical criterion). Where sub-vectors are used, then the proximity of a pulse in one sub-vector to pulses in an adjacent sub-vector needs to be considered; terms involving a pulse pair within the same sub-vector probably cannot be ignored. For example, if we suppose that there are three pulses per sub-vector we may assume that:

(a) terms involving the first pulse of the first sub-vector and the second or third pulse of the second sub-vector; and (b) terms involving the second pulse of the first sub-vector and the third pulse of the second sub-vector may be ignored.

We claim:

1. A speech signal coding apparatus comprising:

(a) means for analysing an input speech signal to generate variable control signal parameters of a speech synthesis filter; and (b) means for selecting at least one excitation signal component from a plurality of available signal components by generating the scalar product of the response signal of the filter to an excitation signal component and the response signal of the filter to an excitation signal component, including means for forming the signal product of a filter response signal matrix H and its transpose signal matrix $H^T$ to form a product signal matrix $H^TH$; said selecting means including;

(c) a first store for storing elements of the product signal matrix $H^TH$;

(d) a second store storing, for each pair of an excitation signal component and an excitation signal component, the address of each location in the first store which contains an element of the product signal matrix which is to be multiplied by nonzero signal elements of both excitation components of the pair; and (e) means operable to retrieve addresses from the second store, to retrieve the signal contents of locations in the first store thereby addressed, and to add the retrieved signal contents.

2. A speech signal coding apparatus comprising;

(a) means for analysing an input speech signal to generate variable control signal parameters of a speech synthesis filter; and (b) means for selecting at least one excitation signal component from a plurality of available signal components by generating the scalar product of the response signal of the filter to an excitation signal component and the response signal of the filter to an excitation signal component, including means for forming the signal product of a filter response signal matrix H and its transpose signal matrix $H^T$ to form a product signal matrix $H^TH$; a plurality of available signal components including a plurality of subsets of signal components, each signal component of a subset being a shifted version of another member of the same subset, said selecting means including;

(c) a first store for storing elements of the product signal matrix $H^TH$;

(d) a second store storing, for one representative signal component of each subset of excitation signal components, the addresses of each location in the first store which contains an element of the product signal matrix which is to be multiplied by nonzero elements of the representative signal component; and (e) means operable to retrieve addresses from the second store, to modify the addresses in respect of signal components other than the representative signal components, to retrieve the contents of the location in the first store thereby addressed, and to add the retrieved signal contents.

3. A speech signal coding apparatus comprising;

(a) means for analysing an input speech signal to generate variable control signal parameters of speech synthesis filter; and (b) means for selecting at least one excitation signal component from a plurality of available signal components by generating the scalar product of the response signal of the filter to an excitation signal component and the response signal of the filter to an excitation signal component, including means for forming the signal product of a filter response signal matrix H and its transpose signal matrix $H^T$ to form a product signal matrix $H^TH$; each of the signal components being formed by concatenation of a plurality of partial signal components from a set of partial signal components; the selecting means including;

(c) a first store for storing elements of the product signal matrix $H^TH$;

(d) a second store storing, for partial signal components, the addresses of locations in the first store which contain an element of the product signal matrix which is to be multiplied by nonzero signal elements of the partial signal component;

(e) means operable to retrieve addresses from the second store, to retrieve the contents of the location in the first store with the aid of those addresses, and to add the retrieved contents to form partial signal products, and to add partial signal products to produce the said scalar signal products.

4. A speech signal coding apparatus comprising:

(a) means for analysing an input speech signal to generate variable control signal parameters of speech synthesis filter; and (b) means for selecting at least one excitation signal component from a plurality of available signal components by generating the scalar product of the response signal of the filter to an excitation signal component and the response signal of the filter to an excitation signal component, including means for forming the signal product of a filter response signal matrix H and its transpose signal matrix $H^T$ to form a product signal matrix $H^TH$; each of the signal components being formed by concatenation of a plurality of partial signal components from a set of partial signal components;

the selecting means including;

(c) a first store for storing elements of the product signal matrix $H^TH$;

(d) a second store storing, for partial signal components, the addresses of locations in the first store which contain an element of the product signal matrix which is to be multiplied by nonzero signal elements of the partial signal component;

(d) means operable to retrieve addresses from the second store, to retrieve the contents of the location in the first store with the aid of those addresses, and to add the retrieved contents to form partial signal products, and to add partial signal products to produce the said scalar signal products;

each set of partial signal components including a plurality of subsets of partial signal components, each partial signal component of a subset being a shifted version of another member of the same subset, in which the second store contains only addresses corresponding to a representative partial signal component of each subset, and the retrieval means is operable to modify addresses in respect of signal components other than representative signal components.

5. A method of processing input speech signals to generate variable control signal parameters of a speech synthesis filter and to generate signal parameters of an excitation signal which, when applied at a decoder to a filter having the generated filter parameters produces an output signal resembling the input speech signal, said method including the steps of:

a. generating control signal parameters of a predictor for producing from a past excitation signal a partial excitation signal which would produce from the filter a signal resembling the input speech signal;

b. generating a further excitation signal component which, when added to the partial excitation signal, produces a total excitation signal which would produce from the filter a signal better resembling the input speech signal;

wherein the generating of predictor control signal parameters comprises:

(i) producing (a) partial signal excitations each consisting of single past excitation signal samples delayed by a respective amount and (b) partial signal excitations each consisting of samples formed by weighted addition of at least two past excitation signal samples delayed by a respective amount;

(ii) generating the difference between the input speech signal and the response signal of the filter to each partial signal excitation the partial excitation signal being scaled to minimise the said difference, and selecting that partial excitation signal producing the smallest difference, the prediction control signal parameters being a delay signal, a signal indicating whether single or added past signal samples are employed, and a scaling factor signal.

* * * * *